US010934500B2

(12) United States Patent
Han et al.

(10) Patent No.: US 10,934,500 B2
(45) Date of Patent: Mar. 2, 2021

(54) METHOD FOR EFFICIENTLY REGENERATING WASTE LUBRICATING OIL

(71) Applicant: Taizhou University, Taizhou (CN)

(72) Inventors: Deman Han, Taizhou (CN); Fangyu Zhou, Taizhou (CN); Rongrong Li, Taizhou (CN)

(73) Assignee: TAIZHOU UNIVERSITY, Taizhou (CN)

( * ) Notice: Subject to any disclaimer, the term of this patent is extended or adjusted under 35 U.S.C. 154(b) by 0 days.

(21) Appl. No.: 16/553,280

(22) Filed: Aug. 28, 2019

(65) Prior Publication Data

US 2020/0071635 A1 Mar. 5, 2020

(30) Foreign Application Priority Data

Aug. 31, 2018 (CN) ..... 201811011455.8

(51) Int. Cl.
*C10M 175/00* (2006.01)

(52) U.S. Cl.
CPC ..... *C10M 175/0058* (2013.01); *C10M 175/0016* (2013.01); *C10M 175/0025* (2013.01)

(58) Field of Classification Search
CPC ..... C10M 175/0016; C10M 175/025; C10M 175/0058
See application file for complete search history.

(56) References Cited

U.S. PATENT DOCUMENTS 4,038,176 A * 7/1977 Noren ..... C10M 175/0016 208/180
2014/0145309 A1* 5/2014 Grabbe ..... C10M 175/0058 257/618

FOREIGN PATENT DOCUMENTS

CN ZL201511032922.1 B 4/2016
CN ZL201511031611.3 B 5/2016

* cited by examiner

*Primary Examiner* — James C Goloboy
(74) *Attorney, Agent, or Firm* — Tutunjian & Bitetto, P.C.

(57) ABSTRACT

The present invention relates to a method for efficiently regenerating waste lubricating oil and belongs to the technical field of waste lubricating oil recovery and treatment. The method for efficiently regenerating waste lubricating oil is provided to solve a problem that existing waste lubricating oil has a high metal ion content. The method includes: adding the waste lubricating oil into a reaction vessel, performing a stirring treatment under the action of a cuprous-containing catalyst to form an aggregate, and then performing filtration and separation to directly remove the aggregate, to obtain corresponding regenerated lubricating oil. The present invention can effectively realize separation and removal of a metal ion, directly filter and separate, avoid emulsification, and obtain high quality lubricating oil having a low total metal ion content.

20 Claims, No Drawings

METHOD FOR EFFICIENTLY REGENERATING WASTE LUBRICATING OIL

This application claims priority to Chinese application number 201811011455.8, filed Aug. 31, 2018, with a title of METHOD FOR EFFICIENTLY REGENERATING WASTE LUBRICATING OIL. The above-mentioned patent application is incorporated herein by reference in its entirety.

TECHNICAL FIELD

The present invention relates to a method for efficiently regenerating waste lubricating oil, and belongs to the technical field of waste lubricating oil recovery and treatment.

BACKGROUND

In the field of petrochemical industry, with the rapid development of economy and technology at home and abroad, the application of lubricating oil products is becoming wider and wider, and the demand for lubricating oil products is getting higher and higher. But, at the same time, a large amount of waste lubricating oil is produced, which causes great harm to the environment and wastes a lot of resources.

At present, domestic mature waste lubricating oil regeneration methods mainly use conventional physical methods such as distillation, solvent washing and carclazyte refining, and the technology of hydrotreating waste lubricating oil is still in a research stage, and the process is not satisfactory. However, both conventional waste lubricating oil regeneration and the method of waste lubricating oil hydrotreatment have the following shortcomings: the loss of the raw material of waste lubricating oil is 20%-50%, and the utilization rate of the raw material of waste lubricating oil is low; the product has a poor property but a high chromaticity, and can only be used as low-grade lubricating oil; pollutants such as acid slag and sulfide are produced during treatment, which are cumbersome and costly to treat; and after hydrotreating, the property of the lubricating oil is improved, but light stability and heat stability are poor, and the product is prone to discoloration and precipitation. Some existing methods use a solvent for flocculation separation, but the solvent methods are prone to emulsification, which is not conducive to actual operation and separation, and the methods also require post-treatment of the added solvent with complicated process operation, which is not conducive to actual production. For example, a Chinese patent application (Publication No.: CN107400556A) discloses a method for regenerating waste lubricating oil, where a flocculant is added to the waste lubricating oil, the flocculant being a mixture of n-butanol, isopropanol and $Mg^{2+}$; after stirring and flocculation separation, collected upper oil needs to be subjected to reduced pressure distillation to recover a solvent and collect a fraction, and a solvent is needed for a purification treatment. The process is too complicated, and the flocculant is prone to emulsification during standing separation, especially during large-scale production, which is not conducive to separation and operation.

SUMMARY

The present invention is directed to the above defects in the prior art, and provides a method for efficiently regenerating waste lubricating oil, to solve a problem of how to achieve efficient and rapid removal of a metal ion residue in the waste lubricating oil as well as efficient and rapid regeneration of the waste lubricating oil.

The objective of the present invention is achieved by the following technical solution. A method for efficiently regenerating waste lubricating oil, including the following steps:

adding the waste lubricating oil into a reaction vessel, performing a stirring treatment under the action of a cuprous-containing catalyst to form an aggregate, and then performing filtration and separation to directly remove the aggregate, to obtain corresponding regenerated lubricating oil.

As the waste lubricating oil has a high content of aromatic hydrocarbons, metals, heteroatoms and residual carbon, especially a high content of metal ions such as zinc, calcium, sodium and copper, with the content of respective iron ions, calcium ions, sodium ions and zinc ions being 1,500-2,000 ppm, the waste lubricating oil needs to be treated before recycling. In the present invention, by adding the cuprous-containing catalyst directly to the waste lubricating oil, these impurity components in the waste lubricating oil can be effectively aggregated around the particulate matter of cuprous catalyst-containing catalyst under a stirring state; equivalently, a center of suspended particles is formed in the liquid of lubricating oil; under the stirring state, a mass transfer effect of the substances is aggravated, and the substances are continuously aggregated to expand and become a particle cluster shaped like a large particle, thereby promoting the aggregation and expansion of the particles and achieving a solid-liquid separation effect. Moreover, the addition of the cuprous-containing catalyst forms effective aggregation, which is mainly due to the fact that the cuprous-containing catalyst has a polarity which promotes aggregation and enables interaction with the impurity components in the waste lubricating oil, thereby achieving the effect of aggregation around the cuprous-containing catalyst. Further, the cuprous-containing catalyst is used for aggregating solid particles, eliminating the need to recover a solvent; the quality of the lubricating oil will not be affected by the addition of a flocculant such as an amine, emulsification is not easy to occur, and filtration and separation is directly performed, which facilitates operation and improves the convenience of operation. At the same time, the cuprous-containing catalyst itself is a particulate matter, and can be directly effectively separated and removed in a subsequent filtration and separation process, substantially without introducing a negative ion like a cuprous ion into the lubricating oil. Therefore, after the aggregate is removed by filtration and separation, the lubricating oil can have a higher level of quality, and a total metal content can be controlled below 350 ppm, especially a copper ion content is controlled below 30 ppm, a calcium ion content is controlled below 150 ppm, a zinc ion content is controlled below 50 ppm, a sodium ion content is controlled below 200 ppm, an iron ion content is controlled below 30 ppm, and a total ash removal rate is 93% or more.

In the above method for efficiently regenerating waste lubricating oil, the amount of the cuprous-containing catalyst added into the waste lubricating oil is generally sufficient to promote the aggregation, or in consideration of the efficiency of regeneration, it is also possible to add a little more; both will not affect the regeneration effect of the waste lubricating oil. Preferably, the added mass of the cuprous-containing catalyst is 1%-5% of the mass of the waste lubricating oil, which can effectively aggregate and remove an impurity substance in the waste lubricating oil, and realize faster treatment efficiency and cost control.

In the above method for efficiently regenerating waste lubricating oil, preferably, the cuprous-containing catalyst is selected from one or more of a cuprous-containing alloy, a cuprous complex, and a cuprous halide, which can bring about aggregation and expansion around the catalyst containing a cuprous ion, thereby achieving the purpose of effective separation and removal, and achieving better removal of a metal ion residue, especially zinc, sodium and calcium. More preferably, the cuprous halide is selected from cuprous chloride, cuprous bromide and cuprous iodide. Here, the halides such as the cuprous chloride and the cuprous bromide have a better removal capacity, mainly because of their polarity, which enables the cuprous chloride, the cuprous bromide and the cuprous iodide to interact with various impurity substances in the waste lubricating oil to form a combined or synergistic effect. A cuprous ion plays a major role in promoting the aggregation to form a cluster, thereby achieving the purpose of separation and removal. Especially, these halides have a more efficient capacity to remove metallic copper, zinc, sodium and calcium ions, achieving a total ash removal rate of 96% or more.

In the above method for efficiently regenerating waste lubricating oil, preferably, the temperature of the stirring treatment is 20-60° C. While ensuring effective aggregation, the stirring treatment is basically performed under a lower temperature condition, which is favorable for practical operation. On the other hand, if the temperature is too high, especially exceeding 60° C., the aggregation efficiency will be lowered, which is not conducive to actual operation in production. Additionally, if the temperature is too high, a certain thermodynamic effect will be generated to affect the aggregation efficiency.

In the above method for efficiently regenerating waste lubricating oil, preferably, the stirring speed of the stirring treatment is 1,000 r/min-4,000 r/min. The aggregation is promoted under the action of the stirring speed and a stirring shearing force, which is favorable for promoting the aggregation and improving the efficiency of regeneration.

In the above method for efficiently regenerating waste lubricating oil, preferably, the cuprous-containing catalyst further contains a copper halide, and the content of the copper halide is 0.1%-0.5% of the mass of the cuprous-containing catalyst. By adding a small amount of copper halide, the removal rate can be better improved, and the quality of the lubricating oil can be further ensured. The copper halide here may be copper chloride, copper bromide or copper iodide.

In the above method for efficiently regenerating waste lubricating oil, an adsorption treatment may be further included after the filtration and separation treatment, and an adsorbent is used to improve the quality of the lubricating oil. More preferably, after the filtration and separation treatment, an adsorption treatment using aluminum oxide, carclazyte or clay is included. By the adsorption treatment, a small amount of impurities which may be present in an oil phase can be better removed, thereby further improving the quality of the lubricating oil.

In the above method for efficiently regenerating waste lubricating oil, preferably, the waste lubricating oil is pretreated to become waste lubricating oil free from a mechanical impurity. The purpose is to facilitate subsequent separation, improve the aggregation capacity of the cuprous-containing catalyst after being added, and prevent the cuprous-containing catalyst from being influenced by the mechanical impurity.

In the above method for efficiently regenerating waste lubricating oil, preferably, the waste lubricating oil free from the mechanical impurity is further subjected to a pre-flocculation treatment by using methyltetrahydrofuran methanol to obtain corresponding pretreated waste lubricating oil. The tetrahydrofuran methanol is firstly used for a pre-flocculation regeneration treatment to remove a main impurity from the waste lubricating oil in advance; then, when the impurity in the waste lubricating oil is less, the cuprous-containing catalyst is used for treating, thereby achieving a better treatment effect. For the pretreatment of tetrahydrofuran methanol, the applicant's patent document (Patent No.: ZL201511031611.3), entitled "METHOD FOR REGENERATING WASTE LUBRICATING OIL", and the applicant's patent document (Patent No.: ZL201511032922.1), entitled "ELECTROCHEMICAL REGENERATION TREATMENT METHOD OF WASTE LUBRICATING OIL", are incorporated herein by reference in their entirety.

In conclusion, compared with the prior art, the present invention has the following advantages.

The present invention adds a cuprous-containing catalyst into the waste lubricating oil and forms an aggregate around the cuprous-containing catalyst under a stirring state, achieving effective separation and removal, and achieving a high quality of the lubricating oil; a total metal content can be controlled below 350 ppm, especially a copper ion content is controlled below 30 ppm, a calcium ion content is controlled below 150 ppm, a zinc ion content is controlled below 50 ppm, a sodium ion content is controlled below 200 ppm, an iron ion content is controlled below 30 ppm, and a total ash removal rate is 93% or more.

DETAILED DESCRIPTION

The following describes the technical solution of the present invention in more detail below with reference to specific embodiments, but the specific embodiments may not constitute a limitation to the present invention.

Embodiment 1

Corresponding waste lubricating oil is selected, and is pretreated to remove a mechanical impurity to obtain 38.8 g of corresponding waste lubricating oil free from the mechanical impurity; after determination, the waste lubricating oil has a copper ion content of 200 ppm, a calcium ion content of 1,500 ppm, a sodium ion content of 1,834 ppm, a zinc ion content of 1,987 ppm, and an iron ion content of 570 ppm; then, a cuprous chloride powder is directly added to the waste lubricating oil free from the mechanical impurity, the added mass of the cuprous chloride being 1% of the mass of the waste lubricating oil free from the mechanical impurity; a stirring treatment is performed at a normal temperature for 1 h at a stirring speed of 1,200 rpm/min; when the stirring treatment is completed, a filtration and separation treatment is directly performed to remove an aggregate, a separated oil residue can be reused as asphalt, and 36.9 g of corresponding regenerated lubricating oil is obtained. Corresponding indicators of the obtained lubricating oil are determined, and the results show that, a total metal content is <300 ppm, a total ash removal rate is ≥96%, a copper iron content is 26 ppm, a calcium ion content is 124 ppm, a sodium ion content is 85 ppm, a zinc ion content is 30 ppm, and an iron ion content is 28 ppm.

Here, the regenerated lubricating oil may be further subjected to an adsorption treatment, specifically, the liquid of lubricating oil collected after the filtration and separation treatment is further subjected to the adsorption treatment by adding aluminum oxide, the added amount of the aluminum oxide being 2%, and is filtered to further obtain high quality regenerated lubricating oil. The quality of the regenerated lubricating oil after the adsorption treatment is as follows: a total metal content is <280 ppm, a total ash removal rate is ≥97%, a copper iron content is 23 ppm, a calcium ion content is 117 ppm, a sodium ion content is 81 ppm, a zinc ion content is 28 ppm, and an iron ion content is 25 ppm. It can be seen from the results that the cuprous chloride used in a previous step has a major role and an obvious treatment effect in the removal of an impurity.

Embodiment 2

Corresponding waste lubricating oil is selected, and is pretreated to remove a mechanical impurity to obtain 41.2 g of corresponding waste lubricating oil free from the mechanical impurity; after determination, the waste lubricating oil has a copper ion content of 212 ppm, a calcium ion content of 1,140 ppm, a sodium ion content of 1,741 ppm, a zinc ion content of 1,754 ppm, and an iron ion content of 586 ppm; then, a cuprous chloride powder is directly added to the waste lubricating oil free from the mechanical impurity, the added mass of the cuprous chloride being 2% of the mass of the waste lubricating oil; a stirring treatment is performed at a temperature of 20-25° C. for 2.0 h at a stirring speed of 1,000 rpm/min; when the stirring treatment is completed, a filtration and separation treatment is directly performed to remove an aggregate, a separated oil residue can be reused as asphalt, and 39.8 g of corresponding regenerated lubricating oil is obtained. Corresponding indicators of the obtained lubricating oil are determined, and the results show that, a total metal content is <350 ppm, a total ash removal rate is ≥97%, a copper iron content is 31 ppm, a calcium ion content is 150 ppm, a sodium ion content is 77 ppm, a zinc ion content is 42 ppm, and an iron ion content is 29 ppm.

Here, the regenerated lubricating oil may be further subjected to an adsorption treatment, specifically, the liquid of lubricating oil collected after the filtration and separation treatment is further subjected to the adsorption treatment for 1.5 h by adding carclazyte, the added amount of the carclazyte being 3% of the mass of the collected liquid of lubricating oil, and is filtered to further obtain high quality regenerated lubricating oil. The quality of the regenerated lubricating oil after the adsorption treatment is as follows: a total metal content is <300 ppm, a total ash removal rate is ≥97.5%, a copper iron content is 27 ppm, a calcium ion content is 126 ppm, a sodium ion content is 62 ppm, a zinc ion content is 38 ppm, and an iron ion content is 26 ppm.

Embodiment 3

Corresponding waste lubricating oil is selected, and is pretreated to remove a mechanical impurity to obtain 42.5 g of corresponding waste lubricating oil free from the mechanical impurity; after determination, the waste lubricating oil has a copper ion content of 230 ppm, a calcium ion content of 1,470 ppm, a sodium ion content of 1,715 ppm, a zinc ion content of 1,658 ppm, and an iron ion content of 568 ppm; then, a cuprous bromide powder is directly added to the waste lubricating oil free from the mechanical impurity, the added mass of the cuprous chloride being 5% of the mass of the waste lubricating oil; a stirring treatment is performed at a temperature of 30-35° C. for 1.0 h at a stirring speed of 2,000 rpm/min; when the stirring treatment is completed, a filtration and separation treatment is directly performed to remove an aggregate, a separated oil residue (solid) can be reused as asphalt, and 40.8 g of corresponding regenerated lubricating oil is obtained. Corresponding indicators of the obtained lubricating oil are determined, and the results show that, a total metal content is <290 ppm, a total ash removal rate is ≥97%, a copper iron content is 30 ppm, a calcium ion content is 112 ppm, a sodium ion content is 81 ppm, a zinc ion content is 27 ppm, and an iron ion content is 27 ppm.

Here, the regenerated lubricating oil may be further subjected to an adsorption treatment, specifically, the liquid of lubricating oil collected after the filtration and separation treatment is further subjected to the adsorption treatment for 1.0 h by adding a mixture of clay and carclazyte, the added amount of the mixture of clay and carclazyte being 3% of the mass of the collected liquid of lubricating oil, and is filtered to further obtain high quality regenerated lubricating oil. Corresponding indicators of the obtained lubricating oil are further tested, and the results show that, a total metal content is <275 ppm, a total ash removal rate is ≥97.3%, a copper iron content is 28 ppm, a calcium ion content is 110 ppm, a sodium ion content is 79 ppm, a zinc ion content is 26 ppm, and an iron ion content is 25 ppm.

Embodiment 4

Corresponding waste lubricating oil is selected, and is pretreated to remove a mechanical impurity to obtain 39.5 g of corresponding waste lubricating oil free from the mechanical impurity; after determination, the waste lubricating oil has a copper ion content of 260 ppm, a calcium ion content of 1,452 ppm, a sodium ion content of 1,724 ppm, a zinc ion content of 1,756 ppm, and an iron ion content of 576 ppm; then, a mixed powder of cuprous chloride and copper chloride is directly added to the waste lubricating oil free from the mechanical impurity, the added mass of the mixed powder being 3% of the mass of the waste lubricating oil, and the copper chloride being 0.1% the mass of the cuprous chloride; a stirring treatment is performed at a temperature of 35-40° C. for 2.0 c at a stirring speed of 4,000 rpm/min; when the stirring treatment is completed, a filtration and separation treatment is directly performed to remove a floccule, a separated oil residue can be reused as asphalt, and 37.8 g of corresponding regenerated lubricating oil is obtained. Corresponding indicators of the obtained lubricating oil are determined, and the results show that, a total metal content is <265 ppm, a total ash removal rate is ≥97%, a copper iron content is 26 ppm, a calcium ion content is 112 ppm, a sodium ion content is 52 ppm, a zinc ion content is 28 ppm, and an iron ion content is 31 ppm. Here, the addition of the copper chloride also increases the removal rate of calcium and sodium ions.

The regenerated lubricating oil is further subjected to an adsorption treatment, specifically, the liquid of lubricating oil collected after the filtration and separation treatment is further subjected to the adsorption treatment by adding aluminum oxide, the added amount of the aluminum oxide being 2%, and is filtered to further obtain high quality regenerated lubricating oil. Corresponding indicators of the obtained lubricating oil are further tested, and the results show that, a total metal content is <250 ppm, a total ash removal rate is ≥97%, a copper iron content is 28 ppm, a calcium ion content is 108 ppm, a sodium ion content is 49 ppm, a zinc ion content is 27 ppm, and an iron ion content is 25 ppm.

Embodiment 5

Corresponding waste lubricating oil is selected, and is pretreated to remove a mechanical impurity to obtain 39.5 g of corresponding waste lubricating oil free from the mechanical impurity; after determination, the waste lubricating oil has a copper ion content of 285 ppm, a calcium ion content of 1,242 ppm, a sodium ion content of 1,624 ppm, a zinc ion content of 1,546 ppm, and an iron ion content of 572 ppm; then, a mixed powder of cuprous chloride and copper chloride is directly added to the waste lubricating oil free from the mechanical impurity, the added mass of the mixed powder being 3% of the mass of the waste lubricating oil, and the copper chloride being 0.5% the mass of the cuprous chloride; a stirring treatment is performed at a temperature of 35-40° C. for 2.0 h at a stirring speed of 3,000 rpm/min; when the stirring treatment is completed, a filtration and separation treatment is directly performed to remove an aggregate, a separated oil residue can be reused as asphalt, and 37.8 g of corresponding regenerated lubricating oil is obtained. Corresponding indicators of the obtained lubricating oil are determined, and the results show that, a total metal content is <270 ppm, a total ash removal rate is ≥97.5%, a copper iron content is 28 ppm, a calcium ion content is 115 ppm, a sodium ion content is 49 ppm, a zinc ion content is 31 ppm, and an iron ion content is 28 ppm. Here, the addition of the copper chloride also increases the removal rate of calcium and sodium ions.

The regenerated lubricating oil is further subjected to an adsorption treatment, specifically, the liquid of lubricating oil collected after the filtration and separation treatment is further subjected to the adsorption treatment by adding aluminum oxide, the added amount of the aluminum oxide being 3%, and is filtered to further obtain high quality regenerated lubricating oil. Corresponding indicators of the obtained lubricating oil are further tested, and the results show that, a total metal content is <255 ppm, a total ash removal rate is ≥97.6%, a copper iron content is 27 ppm, a calcium ion content is 112 ppm, a sodium ion content is 47 ppm, a zinc ion content is 30 ppm, and an iron ion content is 25 ppm.

Embodiment 6

Corresponding waste lubricating oil is selected, and is pretreated to remove a mechanical impurity to obtain 40.2 g of corresponding waste lubricating oil free from the mechanical impurity; after determination, the waste lubricating oil has a copper ion content of 142 ppm, a calcium ion content of 1,554 ppm, a sodium ion content of 1,539 ppm, a zinc ion content of 1,751 ppm, and an iron ion content of 567 ppm; then, a cuprous-containing alloy powder (an alloy containing cuprous oxide) is directly added to the waste lubricating oil free from the mechanical impurity, the added mass of the cuprous-containing alloy being 3% of the mass of the waste lubricating oil free from the mechanical impurity; a stirring treatment is performed at a normal temperature for 2.0 h at a stirring speed of 1,100 rpm/min; when the stirring treatment is completed, a filtration and separation treatment is directly performed to remove an aggregate, a separated oil residue can be reused as asphalt, and 38.6 g of corresponding regenerated lubricating oil is obtained. Corresponding indicators of the obtained lubricating oil are determined, and the results show that, a total metal content is <350 ppm, a total ash removal rate is ≥93%, a copper iron content is 43 ppm, a calcium ion content is 137 ppm, a sodium ion content is 74 ppm, a zinc ion content is 48 ppm, and an iron ion content is 32 ppm.

Embodiment 7

Corresponding waste lubricating oil is selected, and is pretreated to remove a mechanical impurity to obtain 39.4 g of corresponding waste lubricating oil free from the mechanical impurity; after determination, the waste lubricating oil has a copper ion content of 152 ppm, a calcium ion content of 1,459 ppm, a sodium ion content of 1,469 ppm, a zinc ion content of 1,673 ppm, and an iron ion content of 579 ppm; then, a cuprous complex particle powder (an alloy containing cuprous oxide) is directly added to the waste lubricating oil free from the mechanical impurity, the added mass of the cuprous complex being 4% of the mass of the waste lubricating oil free from the mechanical impurity; a stirring treatment is performed at a normal temperature for 1.5 h at a stirring speed of 1,200 rpm/min; when the stirring treatment is completed, a filtration and separation treatment is directly performed to remove an aggregate, a separated oil residue can be reused as asphalt, and 37.8 g of corresponding regenerated lubricating oil is obtained. Corresponding indicators of the obtained lubricating oil are determined, and the results show that, a total metal content is <350 ppm, a total ash removal rate is ≥94%, a copper iron content is 47 ppm, a calcium ion content is 146 ppm, a sodium ion content is 68 ppm, a zinc ion content is 47 ppm, and an iron ion content is 29 ppm. Further, it is also possible to post-treat by adding an adsorbent for secondary purification.

Embodiment 8

In the present embodiment, a regeneration treatment is first performed by using tetrahydrofuran methanol, specifically, a pre-flocculation regeneration treatment is performed by using a regeneration method in a patent document (ZL201511031611.3), and then a secondary regeneration treatment is performed by adding copper chloride. Specifically:

Corresponding waste lubricating oil is selected, which has a phosphorus content of 3,671 ppm by determination by using a conventional method; then, the waste lubricating oil and tetrahydrofuran methanol are directly added to a reactor in proportion, preferably, the volume ratio of the solvent of tetrahydrofuran methanol to the waste lubricating oil being 1.5:1; the waste lubricating oil and the tetrahydrofuran methanol are stirred and mixed for 1 h at a stirring speed of 1,000 rpm/min under a normal temperature condition; the mixture is subjected to a standing treatment for layering for 8 h; a lower layer of flocculated oil residue phase is separated, and of course, the separated oil residue can be utilized as asphalt; a collected upper layer of lubricating oil phase is subjected to a phase separation treatment by a three-phase centrifuge by using a three-phase centrifugal method; a large-particle solid matter is removed, and then reduced pressure distillation is performed to recover the solvent of tetrahydrofuran methanol to obtain regenerated lubricating oil, the temperature of the reduced pressure distillation being 90° C., and the pressure being −0.1 MPa. Corresponding mass indicators are determined, and the regenerated lubricating oil has a total metal content <200 ppm, a total ash removal rate >90%, and a phosphorus content of 158 ppm.

Then, 42.1 g of the obtained regenerated lubricating oil is selected, and a cuprous chloride powder is directly added, the added mass of the cuprous chloride being 2% of the mass of the regenerated lubricating oil; a stirring treatment is performed for 1 h under a normal temperature condition at a stirring speed of 1,200 rpm/min; when the stirring treatment is completed, a filtration and separation treatment is directly performed to remove an aggregate, to obtain 41.3 g of corresponding regenerated lubricating oil. Corresponding indicators of the obtained lubricating oil are determined, and the results show that, a total metal content is <200 ppm, a total ash removal rate is ≥96%, a phosphorus content is 98 ppm, a copper iron content is 18 ppm, a calcium ion content is 95 ppm, a sodium ion content is 75 ppm, a zinc ion content is 21 ppm, and an iron ion content is 25 ppm.

Comparative Example 1

To illustrate that the cuprous halide used by the present invention has better removal efficiency and capacity, the present comparative example is carried out by using a different salt substitute. The present comparative example uses ferric chloride for comparison, as follows:

corresponding waste lubricating oil is selected, and is pretreated to remove a mechanical impurity to obtain corresponding waste lubricating oil free from the mechanical impurity; after determination, the waste lubricating oil has a copper ion content of 260 ppm, a calcium ion content of 1,240 ppm, a sodium ion content of 1,246 ppm, and a zinc ion content of 1,542 ppm; then, a ferric trichloride powder is directly added to the waste lubricating oil free from the mechanical impurity, the added mass of the ferric trichloride being 3% of the mass of the waste lubricating oil; a stirring treatment is performed at a temperature of 35-40° C. for 2.0 h at a stirring speed of 2,000 rpm/min; here, when the stirring treatment is completed, the aggregation of a particulate matter is not obvious, and filtration and separation are performed to obtain corresponding regenerated lubricating oil. Corresponding indicators of the obtained lubricating oil are determined, and the results show that, a copper iron content is 241 ppm, a calcium ion content is 1,212 ppm, a sodium ion content is 1,185 ppm, and a zinc ion content is 1,478 ppm. Basically, the purpose of aggregation removal cannot be achieved.

The specific embodiments described in the present invention are merely illustrative of the spirit of the present invention. A person skilled in the art can make various modifications or supplements to the specific embodiments described or replace them in a similar manner, but it may not depart from the spirit of the present invention or the scope defined by the appended claims.

Although the present invention has been described in detail and some specific embodiments are cited, it is apparent to those skilled in the art that various changes or modifications may be made without departing from the spirit and scope of the present invention.

What is claimed is:

1. A method for efficiently regenerating waste lubricating oil comprising:

adding the waste lubricating oil into a reaction vessel, performing a stirring treatment in the presence of a cuprous-containing catalyst to form an aggregate, and performing filtration and separation to directly remove the aggregate, to obtain corresponding regenerated lubricating oil.

2. The method for efficiently regenerating waste lubricating oil according to claim 1, wherein the added mass of the cuprous-containing catalyst is 1.0%-5.0% of the mass of the waste lubricating oil.

3. The method for efficiently regenerating waste lubricating oil according to claim 1, wherein the cuprous-containing catalyst is selected from one or more selected from the group consisting of of a cuprous-containing alloy, a cuprous complex, and a cuprous halide.

4. The method for efficiently regenerating waste lubricating oil according to claim 3, wherein the cuprous halide is selected from cuprous chloride, cuprous bromide and cuprous iodide.

5. The method for efficiently regenerating waste lubricating oil according to claim 1, wherein the temperature of the stirring treatment is 20-40° C.

6. The method for efficiently regenerating waste lubricating oil according to claim 2, wherein the temperature of the stirring treatment is 20-40° C.

7. The method for efficiently regenerating waste lubricating oil according to claim 3, wherein the temperature of the stirring treatment is 20-40° C.

8. The method for efficiently regenerating waste lubricating oil according to claim 4, wherein the temperature of the stirring treatment is 20-40° C.

9. The method for efficiently regenerating waste lubricating oil according to claim 1, wherein the stirring speed of the stirring treatment is 1,000 r/min-4,000 r/min.

10. The method for efficiently regenerating waste lubricating oil according to claim 2, wherein the stirring speed of the stirring treatment is 1,000 r/min-4,000 r/min.

11. The method for efficiently regenerating waste lubricating oil according to claim 3, wherein the stirring speed of the stirring treatment is 1,000 r/min-4,000 r/min.

12. The method for efficiently regenerating waste lubricating oil according to claim 4, wherein the stirring speed of the stirring treatment is 1,000 r/min-4,000 r/min.

13. The method for efficiently regenerating waste lubricating oil according to claim 1, wherein the cuprous-containing catalyst further contains a copper halide, and the content of the copper halide is 0.1%-0.5% of the mass of the cuprous-containing catalyst.

14. The method for efficiently regenerating waste lubricating oil according to claim 2, wherein the cuprous-containing catalyst further contains a copper halide, and the content of the copper halide is 0.1%-0.5% of the mass of the cuprous-containing catalyst.

15. The method for efficiently regenerating waste lubricating oil according to claim 3, wherein the cuprous-containing catalyst contains a cuprous halide, and the content of the cuprous halide is 0.1%-0.5% of the mass of the cuprous-containing catalyst.

16. The method for efficiently regenerating waste lubricating oil according to claim 4, wherein the cuprous-containing catalyst contains a cuprous halide, and the content of the cuprous halide is 0.1%-0.5% of the mass of the cuprous-containing catalyst.

17. The method for efficiently regenerating waste lubricating oil according to claim 1, further comprising an adsorption treatment comprising contacting the regenerated lubricating oil with aluminum oxide, carclazyte or clay after the filtration and separation treatment.

18. The method for efficiently regenerating waste lubricating oil according to claim 2, further comprising an adsorption treatment comprising contacting the regenerated lubricating oil with aluminum oxide, carclazyte or clay after the filtration and separation treatment.

19. The method for efficiently regenerating waste lubricating oil according to claim 1, wherein the waste lubricating oil is pretreated to become waste lubricating oil free from a mechanical impurity.

20. The method for efficiently regenerating waste lubricating oil according to claim 19, wherein the waste lubricating oil free from the mechanical impurity is further subjected to a pre-flocculation regeneration treatment by contacting methyltetrahydrofuran methanol with waste lubricating oil to obtain corresponding pretreated waste lubricating oil.

* * * * *